United States Patent [19]

Baysinger et al.

[11] 4,034,911

[45] July 12, 1977

[54] BURNER CONTROL SYSTEM

[75] Inventors: Robert L. Baysinger, St. Louis; Harry E. Newport, Jr., Crestwood, both of Mo.

[73] Assignee: Emerson Electric Co., St. Louis, Mo.

[21] Appl. No.: 637,708

[22] Filed: Dec. 4, 1975

[51] Int. Cl.[2] ..... F24D 3/00

[52] U.S. Cl. ..... 236/20 R; 236/1 EB; 236/80 C; 236/91 F; 237/8 R

[58] Field of Search ..... 236/91 F, 91 G, 1 EB, 236/20 R, 92 A, 15 BF, 78 B, 91 A, 9 R, 80 C; 237/8 R

[56] References Cited

U.S. PATENT DOCUMENTS

| | | | |
|---|---|---|---|
| 2,303,382 | 12/1942 | Newhouse | 236/20 |
| 3,843,049 | 10/1974 | Baysinger | 236/20 R X |

FOREIGN PATENT DOCUMENTS

| | | | |
|---|---|---|---|
| 645,025 | 4/1937 | Germany | 236/20 R |

*Primary Examiner*—William E. Wayner
*Attorney, Agent, or Firm*—Paul A. Becker, Sr.

[57] ABSTRACT

A burner control system for a hot water boiler is responsive to both outlet water temperature and return water temperature to provide a relatively constant outlet water temperature regardless of variations in heat output requirements. A first thermistor responsive to return water temperature is effective to provide on-off control of gas flow to the burner. A second thermistor responsive to outlet water temperature is effective to vary the rate of gas flow to the burner so as to maintain a predetermined outlet water temperature. A timing circuit is effective each time the burner is turned on to delay a high rate of gas flow to the burner.

11 Claims, 2 Drawing Figures

BURNER CONTROL SYSTEM

This invention relates generally to gas burner control systems wherein the rate of gas flow to the burner is varied in accordance with heat output requirements. It more particularly relates to gas burner control systems for a circulating hot water space heating system utilizing instantaneous type boilers requiring high output gas burners which do not operate efficiently at the lower gas flow rates required to satisfy relatively low space heating requirements.

A boiler of the so-called instantaneous type is constructed to provide hot water immediately on demand. To accomplish this function, the quantity of water to be heated by the boiler at any instant is very small, such as 2 to 6 quarts, and the burner capacity is very large, such as several hundred thousand BTu's.

When utilizing boilers of this kind in a system wherein the heat output requirements vary widely, it would be preferable to operate the burner continuously at some constant minimum rate whenever any heat is demanded and to increase the burner output in accordance with increased heat output demands so as to maintain a relatively constant, predetermined, outlet water temperature. However, in heating systems wherein the heat output requirement is at times quite low, such as in a space heating system, a problem exists because the minimum to which these high output gas burners can be turned down is limited. That is to say, the minimum rate of gas flow at which the relatively high output gas burners employed with instantaneous boilers can operate efficiently produces too much heat when the space heating requirement is relatively low and the burner is on constantly. Under these conditions, the boiler water temperature would increase excessively above the predetermined temperature. To overcome this problem, the burner would need to be cycled on and off in order to provide a relatively constant, predetermined, outlet water temperature.

However, when on and off burner operation is controlled by temperature responsive means sensitive only to boiler outlet water temperature, the above condition of relatively low space heating requirement will result in the burner being cycled on and off at a frequency dependent upon the response characteristics of the temperature responsive means. If the response time of the temperature responsive means is relatively slow, the frequency of the burner cycles will be relatively slow and considerable variation in outlet water temperature will result. If the response time is relatively quick, the temperature responsive means will cause the burner to quickly shut off when the outlet water reaches the predetermined temperature and immediately thereafter, because of the small quantity of water circulating through the boiler, water at a lower temperature will flow through the outlet to be sensed by the temperature responsive means, causing the burner to again be turned on immediately. This rapid cycling of the burner is obviously objectionable. Moreover, slugs of water of considerably different temperatures will circulate through the system and preclude effective space heating.

If burner operation is controlled by temperature responsive means sensitive only to boiler inlet or return water temperature, the above condition incident to a relatively low space heating requirement will cause the burner to be cycled at a slow frequency because the rate of change of the return water temperature is considerably less than the rate of change of the outlet water temperature. In such an arrangement, the temperature responsive means causes the burner to shut off when the return water temperature exceeds a predetermined return water temperature set-point. The circulating water eventually cools sufficiently to cause the return water temperature responsive means to again turn on the burner. While such an arrangement functions satisfactorily at a relatively low space heating requirement, it does not function satisfactorily when the heating requirements are greater. That is, when the heating requirements are greater, the outlet water temperature would vary considerably because the temperature responsive means controlling burner operation is responsive only to the return water temperature which has a slow rate of change.

It has been found that by cycling the burner on and off at a low heat output rate in response to variations in the return water temperature and by varying the burner heat output rate in response to variations in boiler outlet water temperature, a relatively constant, predetermined, outlet water temperature can be maintained through a wide range of heating requirements without short cycling of the burner.

It is an object of the present invention to provide a generally new and improved gas burner control system for instantaneous boilers, which maintains a relatively constant outlet water temperature under wide variations in heating requirements.

It is a further object to provide a gas burner control system for an instantaneous boiler in which a first temperature sensing means responsive to return water temperature is effective to control on and off operation of the burner at a reduced heat output rate and a second temperature sensitive means responsive to boiler outlet water temperature is operative to vary the rate of gas flow to the burner so as to maintain a predetermined outlet water temperature.

A further object is to provide a control system as in the preceding paragraph which includes timing circuit means rendered operative each time the burner is turned on to briefly delay a high rate of gas flow to the burner, regardless of the instant heat requirement, so as to prevent flame roll-out, to prevent hunting, and to prevent undesirably high outlet water temperature.

In accordance with the present invention, the rate of gas flow to the burner in an instantaneous boiler used in a circulating hot water space heating system is controlled by a gas valve device having an electrically operated auxiliary fluid pressure control valve for controlling the opening and closing of a fluid pressure operated main valve, and a variably biased pressure regulator valve for varying the operating pressure thereby to variably throttle the main valve. A fixed bias on the pressure regulator provides a maximum throttling of the main valve and a minimum rate of gas flow whenever the auxiliary valve is energized. Electrical control circuit means includes a first thermistor responsive to return water temperature to effect opening and closing of the auxiliary valve. A second thermistor responsive to outlet water temperature is operative to vary, through electromagnetic actuating means, the bias on the pressure regulator, thereby to vary the throttling of the main valve and, consequently, the flow of gas to the burner.

Upon each demand for heating, such as by a space thermostat, gas flows to the burner at a minimum rate provided that the thermistor responsive to return water senses a water temperature below a predetermined return water temperature set-point. After a predetermined time period established by the electrical control circuit means, the thermistor responsive to outlet water temperature is effective to increase the rate of gas flow if the outlet water temperature is below a predetermined outlet water temperature set-point. When the space heating requirements are relatively large, the return water temperature remains below its set-point so that the burner remains on. Under these conditions, the thermistor responsive to outlet water temperature is effective to increase the rate of gas flow as the outlet water temperature drops below its set-point and to decrease the rate of gas flow as the outlet water temperature rises toward its set-point.

When the space heating requirements are relatively low so that the burner, being continuously on at the minimum rate of gas flow, causes the outlet water to be at a temperature higher than is needed to satisfy the heating requirement, the return water temperature will increase until it slightly exeeds its set-point and effects shut-off of the burner. The circulating water now cools until the return water temperature decreases slightly below its set-point whereupon the thermistor responsive to return water temperature again causes the burner to be turned on. Since the rate of change of the return water temperature is relatively slow when the heating requirements are low, the frequency of on-off operation of the burner is low and the outlet water temperature is relatively constant, varying essentially only between the outlet water temperature set-point and the return water temperature set-point.

The above-mentioned and other objects and features of the present invention will become apparent from the following description when read in conjunction with the accompanying drawings.

In the drawings:

FIG. 1 is a diagrammatic illustration of a burner control system constructed in accordance with the invention; and FIG. 2 is a cross-sectional view of the gas valve device employed in the control system.

DESCRIPTION OF THE PREFERRED EMBODIMENT

Figure 1:
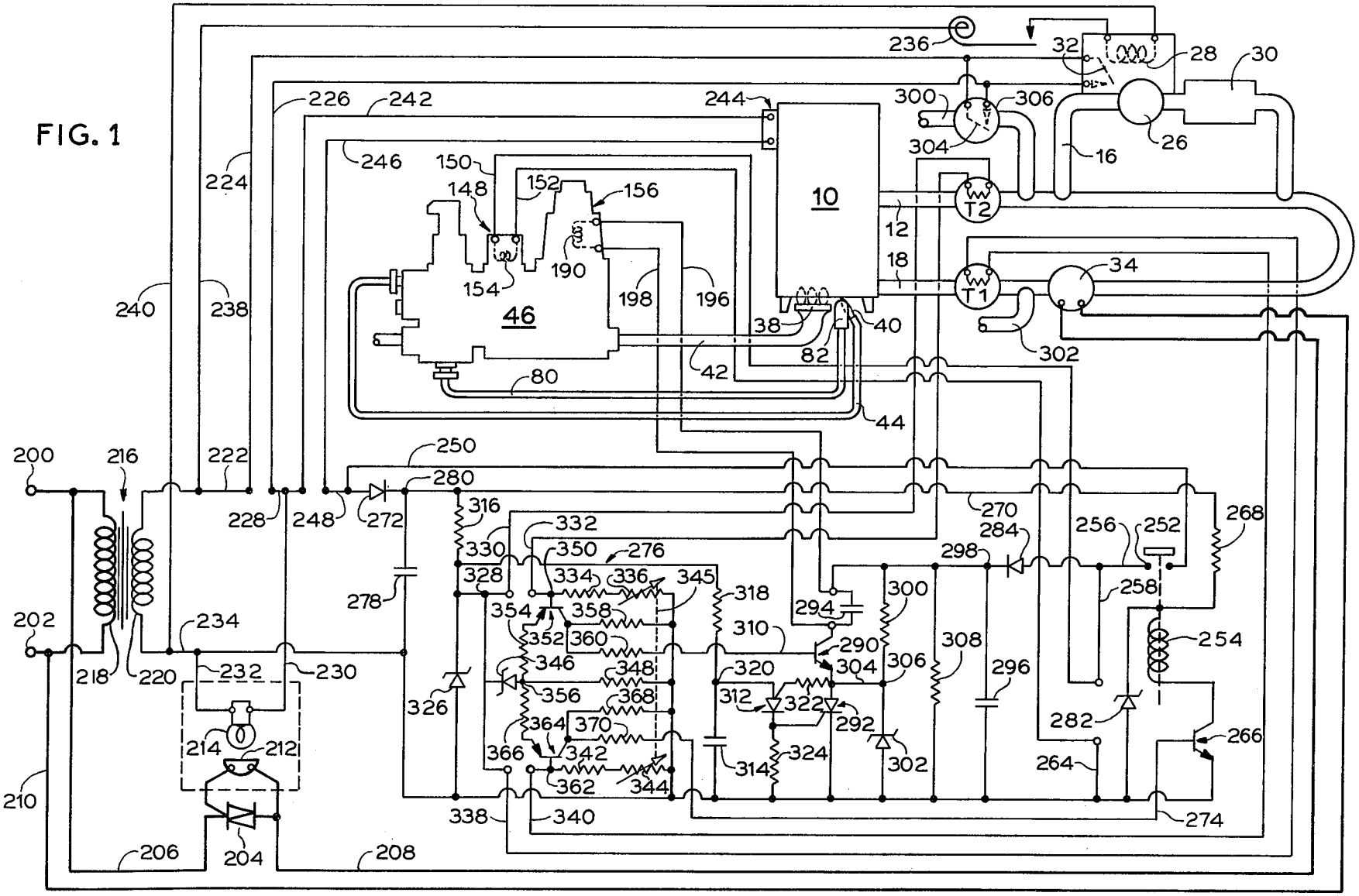

Referring to FIG. 1 of the drawings, an instantaneous hot water boiler is generally indicated at 10. Boiler 10 has a hot water outlet conduit 12 for supplying hot water to conduit 16 for space heating purposes. Boiler 10 also has a conduit 18 through which water is returned to the boiler 10. The boiler 10 includes a heat exchange coil (not shown), opposite ends of which are connected to outlet conduit 12 and return conduit 18.

Interposed in conduit 16 is a zone valve 26 having an operating coil 28 which, when energized, permits water to flow to a radiator 30 and which, when energized, also effects the closing of a normally open auxiliary switch 32. A circulating pump 34 is interposed in return conduit 18 to effect circulation through the boiler 10 and, when zone valve 26 is open, through the radiator 30. It is to be understood that the space heating system can include more than the one heating zone shown. Each additional zone would have its radiator and thermostatically controlled zone valve connected to outlet conduit 12 in the same manner as zone valve 26 and radiator 30 shown in FIG. 1.

Boiler 10 further includes a main gas burner 38 and a pilot burner 40. Gas is supplied through a mian burner fuel conduit 42 and a pilot burner fuel conduit 44 under control of a manifold gas valve generally indicated at 46.

DESCRIPTION OF MANIFOLD GAS VALVE

Figure 2:
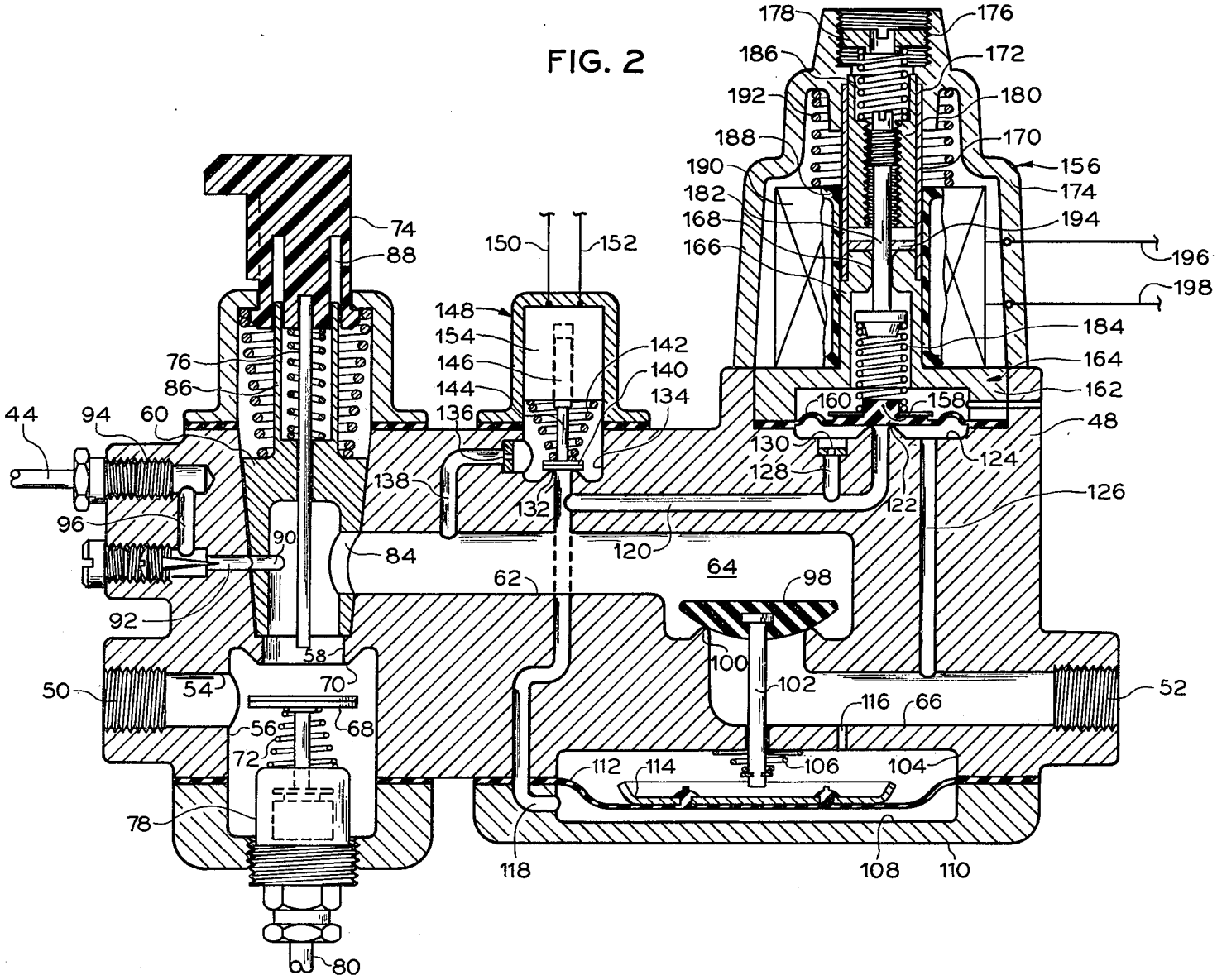

The manifold gas valve device 46 is essentially the same as that disclosed in U.S. Pat. No. 3,843,049. Referring to FIG. 2 of the drawings, the manifold gas valve device 46 comprises a main body member 48 having an inlet 50 for connection to a source of gas supply under pressure and an outlet 52 to which main burner supply conduit 42 is connected. Inlet 50 and outlet 52 are connected by a passageway 54, a chamber 56, a passageway 58, a hollow rotary plug cook 60, a passageway 62, a chamber 64, and a passageway 66.

A safety cutoff valve 68 cooperates with a seat 70 at the lower end of passageway 58 to cut off flow in the absence of pilot flame. The valve 68 is biased closed by a spring 72 and is manually set in an open position by depressing a knob 74 having a depending pin 76 which engages valve 68. The valve 68 is held open by an electromagnet 78 energized through leads 80 by a thermocouple junction 82 heated by the pilot burner 40, see FIG. 1. The hollow plug cock 60 has a main port 84 in the wall thereof which registers with passageway 62 when the plug cock 60 is rotated to an "on" position. The knob 74 is axially slidable on plug cock 60 on circular spaced, axially extending tangs 86 which enter sockets 88 in the knob 74. The knob 74 is thereby keyed to the plug cock 60 for rotation therewith.

Plug cock 60 is further provided with a small circumferentially extending pilot port 90 in the wall thereof, which port registers with a passageway 92 when the plug cock 60 is in an on position and also when the plug cock 60 is rotated to a "pilot light" position in which port 84 is closed with respect to passageway 62. Passageway 92 is connected to pilot outlet 94 by a passageway 96, and the pilot burner supply conduit 44 is connected to pilot burner outlet 94.

A main valve 98 cooperates with a valve seat 100 formed in chamber 64 and controls the flow from inlet 50 to main burner outlet 52 in accordance with heat output requirements. Valve 98 has a stem 102 extending downward into an upper diaphragm chamber 104 formed as a recess in body 48, and a spring 106 biases valve 98 downward to a closed position on its seat 100. A lower main diaphragm chamber 108 is formed by a cup-shaped member 110 attached by suitable means to body 48. A flexible main diaphragm 112 is clamped at its periphery between body 48 and member 110 and forms a flexible wall between upper and lower main diaphragm chambers 104 and 108. Main diaphragm 112 includes a rigid disc 114 centrally positioned and attached thereto. The disc 114 provides weight to bias the diaphragm 112 in a downward position spaced from the end of valve stem 102.

The upper main diaphragm chamber 104 is adequately vented to outlet passageway 66 through a vent 116, so that the upper side of main diaphragm 112 is constantly exposed to the pressure existing in outlet passageway 66. Communication between the lower main diaphragm chamber 108 and outlet passageway 66 is also provided through a passageway 118, a passageway 120, a valve seat 122, a chamber 124, and a passageway 126. This communication is controlled by a pressure regulator which will later be described. Constant but restricted communication between diaphragm chamber 108 and outlet passageway 66 is provided also by a bypass passageway 128 including a restricting orifice 130 leading from passageway 120 to chamber 124 and bypassing the valve seat 122.

Communication between lower main diaphragm chamber 108 and inlet 50 is provided through the passageway 118, a valve seat 132, a valve chamber 134, a restricting orifice 136, a passageway 138, the main passageway 62, main port 84, hollow plug cock 60, passageway 58, chamber 56, and passageway 54. An auxiliary valve 150 is biased closed on seat 132 by a spring 142 and has a stem 144 connected to the plunger 146 of a solenoid 148. Electrical leads 150 and 152 are connected to the ends of the winding 154 of solenoid 148. The auxiliary valve 140 is opened when the winding 154 of solenoid 148 is energized and closes when the winding 154 is de-energized.

A pressure regulator variably biased by a solenoid actuator is generally indicated at 156 and includes a valve 158 cooperating with seat 122 in chamber 124. The valve 158 is formed as an integral central portion of a flexible diaphragm 160. Diaphragm 160 is clamped at its periphery between body 48 and the lower inverted cup portion 162 of a member generally indicated at 164 which is suitably attached to body 48. Member 164 further includes an upwardly extending, hollow, cylindrical portion 166 having a closed upper end with an axial bore 168 therethrough.

A vertically arranged, thin-walled, plunger guide sleeve 170 has its lower end fitted over a reduced diameter portion of the upper end of cylindrical portion 166 and has its upper end fitted into the lower portion of an axial bore 172 extending through the upper closed end of an inverted cup-shaped cover member 174. Cover member 174 is detachably connected at its lower open end in any suitable manner, as by screws, to the body member 48. The upper end portion of the bore 172 is screw threaded at 176 and threadedly receives an adjusting screw 178. A solenoid plunger 180 is slidably received in guide sleeve 170.

Plunger 180 has a screw-threaded axial bore therethrough which receives the upper screw-threaded end of a rod 182 in threaded engagement. The rod 182 extends downward through the plunger 180 through the bore 168 into the hollow cylindrical portion 166 of member 164. The lower end of rod 182 is headed and a relatively strong spring 184 is interposed between the headed lower end of rod 182 and the valve 158. A relatively light spring 186 is interposed between the upper end of plunger 180 and the adjustment screw 178.

A spool having a solenoid winding 190 thereon is slipped over the plunger guide sleeve 170 and cylindrical portion 166 of member 164, and a spring 192 holds the spool 188 and winding 190 in position with a considerable portion of the guide sleeve 170 and plunger 180 extending above the winding 190. The member 164 and plunger 180 are constructed of magnetic material, but cover member 174 as well as the plunger guide sleeve 170 are constructed of non-magnetic material so that a considerable portion of the magnetic flux path extends through air.

In this arrangement, flux density and magnetomotive force vary more gradually at a relatively low rate with variation in current flow through the solenoid winding 190. On the other hand, if a complete flux path of high permeability were instead provided, the rate of increase in flux density and magnetomotive force with relation to current increase would be so great that controlling this force by current change would be extremely critical. Moreover, beyond an earlier point of saturation of a highly permeable flux path, the rate of increase in force would drop precipitously to substantially nil. A non-magnetic disc 194 is included between the lower end of plunger 180 and the top of member 164 to prevent sticking of the plunger 180 due to residual magnetism. Circuit leads 196 and 198 are connected to the opposite ends of solenoid winding 190.

OPERATION OF THE MANIFOLD GAS VALVE

The manifold valve device 46 is shown in FIG. 2 in an on position with the hollow plug cock 60 positioned so that gas may flow through its main port 84 to passageway 62 and through its pilot port 90 to pilot burner 40. Also, pilot burner 40 is burning and safety cutoff valve 68 is being held open by electromagnet 78. However, solenoid 148 is not energized, so that auxiliary valve 140 is closed, thereby cutting off communication between inlet 50 and lower main diaphragm 108. Since lower main diaphragm chamber 108 is constantly vented through orifice 130 to outlet passageway 66, the diaphragm 112 is in a lower relaxed position and main valve 98 is biased closed.

Under these conditions, when the water temperature in return conduit 18 drops to a predetermined return water temperature set-point, the winding 154 of solenoid 148 is energized and auxiliary valve 140 opens, providing communication between inlet 50 and lower diaphragm chamber 108 through orifice 136. The constant vent orifice 130 is considerably smaller than orifice 136 so that the pressure in chamber 108 now increases, causing diaphragm 112 to flex upward and move valve 98 openward against spring 106. The amount which valve 98 opens is determined by the rate of pressure bleed-off through the pressure regulator valve seat 122 which, in turn, is determined by the downward biasing force applied to regulator valve 158, either by the lighter spring 186 or by the solenoid plunger 180 acting through stronger spring 184.

Inasmuch as the lower side of regulator diaphragm 160 is in communication with outlet passageway 66, it regulates the gas pressure applied to the metering orifice of main burner 38. If supply pressure at inlet 50 increases for any reason, main valve 98 will open further, resulting in a higher pressure in outlet passageway 66 and at the burner metering orifice. This pressure increase in outlet passageway 66 causes regulator valve 158 to open further, thereby bleeding off the pressure increase at inlet 50 so as to restore the pressure at the burner metering orifice. The minimum regulator bias and therefore the minimum regulated flow of gas to main burner 38 is determined by the relatively light spring 186, which is adjustable by turning screw 178. When the return water temperature is raised sufficiently as a result of burner operation, auxiliary valve 140 closes thereby cutting off fuel to the main burner 38.

If the heating requirements are sufficiently high so that the minimum rate of gas flow does not heat the water sufficiently, the water temperature in outlet conduit 12 drops below a predetermined outlet water temperature set-point and sufficient current is caused to flow through solenoid winding 190 to move solenoid plunger 180 downward, thereby compressing spring 184 and increasing the closing bias on regulator valve 158. This reduces the pressure bleed-off and causes main valve 98 to open further to supply gas at a greater rate to main burner 38. The threaded engagement of the upper end of pin 182 in plunger 180 provides an adjustable connection between plunger 180 and the stronger biasing spring 184. While a valve device of unitary construction described above is preferred because of economics, such a construction is not considered essential to the invention. That is, the various functions of the valve device could be performed equally well by several separate devices with internal passageways in the separate devices.

DESCRIPTION OF THE ELECTRICAL CIRCUIT

Referring to FIG. 1, terminals 200 and 202 are connected to a conventional source of alternating current. The circulating pump 34 in return conduit 18 is electrically connected across terminals 200 and 202 through a triac 204 by leads 206, 208, and 210. A photoconductive cell 212 connected between the control electrode of triac 204 and one of the terminals thereof functions to gate the triac 204 when an adjacent filament lamp 214 is energized.

A transformer 216 has its primary winding 218 connected across terminals 200 and 202 in parallel with the pump 34. The filament lamp 214 is connected across the secondary winding 220 of the transformer 216 through auxiliary switch 32 of zone valve 26 by leads 222, 224, 226, 228, 230, 232, and 234. A space thermostat 236 is connected in series with the operating coil 28 of zone valve 26 across secondary winding 220 by leads 238 and 240. Therefore, whenever switch 32 is closed because thermostat 236 is calling for space heating, filament lamp 214 is energized, triac 204 is conducting, and circulating pump 34 is operating. It is to be understood that each additional zone valve, in a multiple zoning system, would have its controlling thermostat and operating coil also series connected across transformer secondary winding 220.

The winding 154 of the solenoid 148, which operates auxiliary valve 140, is connected across secondary winding 220 through the following circuit: leads 222 and 224, switch 32, leads 226 and 228, a lead 242, a high limit switch 244, leads 246, 248, and 250, normally open contacts 252 of a relay having a winding 254, leads 256, 258, and 150, winding 154, leads 152 and 264, and lead 234. The high limit switch 244 is closed except when the water temperature in boiler 10 exceeds a predetermined high limit setting.

Controlling the energizing of relay winding 254 is an NPN transistor 266. The emitter of transistor 266 is connected by lead 234 to one end of secondary winding 220. The collector of transistor 266 is connected to the other end of secondary winding 220 through relay winding 254, a resistor 268, a lead 270, a diode 272, leads 248 and 246, high limit switch 244, leads 242, 228, and 226, switch 32, and leads 224 and 222. The base of transistor 266 is connected by a lead 274 to a bridge circuit generally indicated at 276. A capacitor 278 is connected between the cathode of diode 272 and lead 234 to provide a filtered d. c. supply at a junction 280. A Zener diode 282 is connected in parallel with the series connected relay winding 254 and transistor 266 to limit the voltage applied thereto.

When switch 32 is closed and relay winding 254 is sufficiently energized through transistor 266 to effect the closing of relay contacts 252, the biased closed auxiliary valve 140 is opened to permit gas to flow to the main burner 38. Bridge circuit 276 controls the conduction of transistor 266 as will be hereinafter described.

The solenoid winding 190 of the pressure regulator 156, which controls the rate of gas flow, is connected in parallel with winding 154 of the solenoid 148 through a diode 284, lead 196, lead 198, an NPN transistor 290, and an SCR 292. A filter capacitor 294 is connected in parallel with winding 190.

A capacitor 296 is connected between the cathode of diode 284 and lead 234 to provide a filtered d. c. supply at a junction 298. A series connected resistor 300 and a Zener diode 302 are connected in parallel with capacitor 296. A lead 304 connects the anode of SCR 292 to a point 306 between resistor 300 and Zener diode 302 so that the voltage at point 306, controlled by Zener diode 302, appears on the anode of SCR 292. A bleed resistor 308 is connected in parallel with capacitor 296 to provide a discharge therefor. The conduction of transistor 290, the base of which is connected by a lead 310 to the bridge circuit 276, is controlled by bridge circuit 276 as will be hereinafter described. The gating of SCR 292 is controlled by a programmable unijunction transistor (PUT) 312. A timing capacitor 314 is connected between leads 270 and 234 in series with resistors 316 and 318, resistor 318 being of high impedance. The anode of the PUT 312 is connected to a point 320 between resistor 318 and timing capacitor 314. The gate of the PUT 312 is connected through an impedance matching resistor 322 to the anode of SCR 292. The cathode of PUT 312 is connected to lead 234 through a resistor 324 and to the control electrode of SCR 292.

The closing of relay contacts 252 enables the establishment of a positive voltage at point 306 and thus on the gate electrode of PUT 312. When the voltage at point 320, and thus on the anode of PUT 312, is approximately 0.6 volts more positive than the voltage at point 306, the PUT fires and gates the SCR 292 causing SCR 292 to conduct. The R-C time constant is such that it requires approximately 20 seconds for timing capacitor 314 to reach a charge sufficient to establish the required voltage at point 320 to effect the firing of PUT 312. Bleed resistor 308 provides a discharge path for capacitor 296 when the relay contacts 252 are open so that the 20 second time period is initiated each time that relay contacts 252 close. This 20 second time period precludes energizing the solenoid winding 190 of the pressure regulator 156, regardless of the conductive condition of transistor 290, to insure that gas flow to the main burner 38 will be at a minimum rate at the start of each burner operation.

A Zener diode 326 is connected in series with resistor 316 between leads 270 and 234 and maintains a voltage at junction 328 for the bridge circuit 276 which extends between junction 328 and lead 234.

One side of the bridge circuit 276 extends from the junction 328 to lead 234 and has an upper arm comprising a lead 330, a thermistor T2, and a lead 332, and a lower arm comprising a pair of series connected resistors 334 and 336, resistor 336 being adjustable. The other side of the bridge circuit 276 extends from the junction 328 to lead 234 and has an upper arm comprising a lead 338, a thermistor T1, and a lead 340, and a lower arm comprising a pair of series connected resistors 342 and 344, resistor 344 being adjustable. Resistors 336 and 344 are adjustable to enable factory calibration of the outlet water temperature set-point and the return water temperature set-point, respectively.

Resistors 336 and 344 are connected together at 345 by any suitable means so that after factory calibration, adjustment of either resistor 336 or 344 results in the same adjustment of the other resistor. This insures that the difference between the two set-points will remain the same. A center leg extends from the junction 328 to lead 234 and comprises a series connected Zener diode 346 and a resistor 348.

Connected to a junction 350 between thermistor T2 and resistor 334 is the base iof PNP transistor 352. The emitter of transistor 352 is connected through a resistor 354 to a junction 356 between Zener diode 346 and resistor 348. The collector of transistor 352 is connected through a biasing resistor 358 to lead 234 and, in parallel with resistor 358, through a resistor 360 and by lead 310 to the base of transistor 290. Connected to a junction 362 between thermistor T1 and resistor 342 is the base of a PNP transistor 364. The emitter of transistor 364 is connected through a resistor 366 to the junction 356 between Zener diode 346 and resistor 348. The collector of transistor 364 is connected through a biasing resistor 368 to lead 234 and, in parallel with resistor 368, through a resistor 370 and by lead 274 to the base of transistor 266.

Thermistor T2 has a negative temperature coefficient of resistance. It is positioned in good heat conducting relationship with the outlet water, preferably directly immersed in outlet conduit 12. The mass of thermistor T2 is very small and its resistance changes quickly and substantially in response to slight changes in outlet water temperature.

Thermistor T1 also has a negative temperature coefficient of resistance and its resistance also changes substantially in response to slight changes in temperature. Thermistor T1 is positioned so as to be responsive to return water temperature. Since the rate of change of the water temperature in return conduit 18 is relatively slow as compared to the rate of change of the water temperature in outlet conduit 12, it is not necessary that thermistor T1 be directly immersed in the water. It has been determined that surface contact between thermistor T1 and the outside of return conduit 18 is adequate.

OPERATION OF THE SYSTEM

In bridge circuit 276, resistor 344 is adjusted to establish the aforementioned return water temperature set-point, the water temperature in return conduit 18, as sensed by thermistor T1, which will cause main burner 38 to turn on, and somewhat above which will cause main burner 38 to shut off. Resistor 336 is adjusted to establish the aformentioned outlet water temperature set-point, the temperature in outlet conduit 12, as sensed by thermistor T2, below which will cause an increased rate of gas flow to main burner 38 and above which will be ineffective to change the rate of gas flow from a minimum rate.

As previously described, the closing of the zone valve auxiliary contacts 32 due to a space heating demand causes circulating pump 34 to be energized. Closing of contacts 32 also connects the remainder of the electrical circuit to the transformer secondary winding 200, through the high limit switch 244. Under these conditions, the temperature of the water in return conduit 18 is generally below the return water temperature set-point, and the resistance of thermistor T1 and the values of resistors 342 and 344 are such that the voltage at junction 362 in bridge circuit 276, and thus on the base of transistor 364, is considerably more negative than the voltage at junction 356, and thus on the emitter of transistor 364, so that transistor 364 is forward biased and conducting sufficiently to turn on transistor 266 sufficiently to effect sufficient current flow through relay winding 254 to enable closing the relay contacts 252. As previously described, the closing of relay contacts 252 enables the winding 154 of the solenoid 148 to be energized, effecting the opening of the auxiliary valve 140 to permit gas to flow to the main burner 38 at a predetermined minimum rate as regulated by the light operating spring 186 in pressure regulator 156.

Also, as previously described, it requires approximately 20 seconds, after the closing of relay contacts 252, for timing capacitor 314 to effect the conduction of SCR 292. Therefore, for approximately 20 seconds, gas flow to the main burner 38 is limited to he minimum rate regardless of the outlet water temperature.

If the heat loss or heat requirement is relatively small, the minimum rate of gas flow enables the burner 38 to rapidly effect an outlet water temperature slightly above the outlet water temperature set-point. Unless the heating demand is terminating by the opening of switch 32, burner 38 remains on at the minimum rate of gas flow, until the return water temperature rises a predetermined amount to effect burner shut-off.

As the return water temperature rises, the resistance of thermistor T1 decreases. As the return water temperature rises slightly above the return water temperature set-point, the resistance of thermistor T1 decreases sufficiently so that the voltage at junction 362 becomes less negative and reduces the conduction level of transistor 364. Resistor 366 in the emitter circuit of transistor 364 retards this reverse biasing. However, after a sufficient increase in resistance of thermistor T1, the conduction level of transistor 364 is no longer sufficient to provide for the conduction level of transistor 266 needed by relay winding 254 so that the relay contacts 252 open, shutting off the burner 38.

When the burner 38 is off and the water is circulating through the system, the return water temperature gradually changes and eventually drops toward the return water temperature set-point. When the return water temperature drops sufficiently, thermistor T1 increases its resistance, causing the voltage at junction 362 to again become sufficiently negative with respect to the voltage at junction 356 to forward bias transistor 364. Conduction of transistor 364 initiates conduction of transistor 266. Resistor 366 retards the forward biasing of transistor 364, requiring more drop in return water temperature before transistor 364 conducts sufficiently to turn on transistor 266 sufficiently to effect the level of energizing of relay winding 254 required to close the relay contacts 252. This retardation is such that the relay contacts 252 close when the temperature of the water in return conduit 18 has dropped to the return water temperature set-point. The difference in the current flow through relay winding 254 between that required to close contacts 252 and that required to hold contacts 252 closed, and the retarding effect of resistor 366, is such that it requires approximately a 5° Fahrenheit rise in water temperature above the return water temperature set-point to effect the opening of relay contacts 252.

If the heat loss through the space heating system is sufficiently large so that gas flow at the minimum rate is insufficient to satisfy the heat output required, the outlet water temperature drops below the outlet water temperature set-point and thermistor T2 is effective to increase the rate of gas flow in a manner now to be described.

When the water temperature in outlet conduit 12 is above the outlet water temperature set-point due to burner operation, the resistance of thermistor T2 is of such a value so as to preclude energizing of solenoid winding 190 of pressure regulator 156. When the water temperature in outlet conduit 12 is only slightly above the outlet water temperature set-point due to burner operation, the resistance of thermistor T2 and the values of resistors 334 and 336 are such that the voltages at junctions 356 and 350, and thus on the emitter and base of transistor 352, respectively, are the same. Transistor 352 is therefore biased off and transistor 290, which controls the energizing of the solenoid winding 190, is also biased off. As outlet water temperature drops toward the outlet water temperature set-point, the resistance of thermistor T2 increases, causing the voltage at junction 350 to become sufficiently negative with respect to the voltage at junction 356 to start the conduction of the transistor 352 at the outlet water temperature set-point. If this condition exists at the conclusion of the twenty second time period and the subsequent gating of SCR 292, the conduction of transistor 352 initiates conduction of transistor 290.

Conduction of transistor 290 enables energizing of the solenoid winding 190 of the pressure regulator 156. As the temperature of the outlet water drops more, transistor 352 and, consequently, transistor 290 conduct more. Increased conduction of transistor 290 enables the rate of current flow in solenoid winding 190 to progressively increase, thus increasing the biasing of pressure regulator 156 so that the rate of gas flow to the main burner 38 is progressively increased to a greater value than the minimum rate. If the temperature of the outlet water continues to drop, the conduction of transistor 290 increases, thereby increasing the closing bias applied to the pressure regulator 156 until the pressure regulator is biased to a closing bias which provides for a maximum rate of gas flow to main burner 38. Resistor 354 retards the biasing of transistor 352 so that the range of modulation between maximum biasing and minimum biasing, as sensed by thermistor T2, is approximately 8° Fahrenheit.

As the temperature of the outlet water rises due to burner operation, the conduction of transistor 290 decreases, thereby decreasing the closing bias applied to the pressure regulator 156. When the outlet water reaches the outlet water temperature set-point, transistor 266 is biased off and gas flow to the main burner 38 is again at the minimum rate.

The aforementioned 20 second time period precludes an immediate large rate of gas flow to the main burner 38 upon starting burner operation and thus prevents flame roll-out which may otherwise occur due to the lack of sufficient initial flow of combustion air required with larger burners. The 20 second time period also provides time for the system to stabilize to some degree so as to prevent hunting of the pressure regulator 156, thus precluding a greater rate of gas flow than is necessary to meet the heat output requirements.

The 20 second time period is also functional if the system is used for supplying domestic hot water in addition to providing for space heating. That is, a domestic supply conduit 300 can be connected to conduit 12, and a fresh water supply conduit 302, for replenishing the quantity of water expended for domestic purposes, can be connected to return conduit 18, as shown in FIG. 1. Contacts 304 in a conventional flow switch 306 are connected in parallel with auxiliary contacts 32 of zone valve 26. In operation, a sufficient flow of water through conduit 300 due to domestic draw-off causes contacts 304 to close and energize the system. In such a system, the 20 second time period prevents extremely high temperature outlet water, which would be undesirable for domestic use.

The above-described system thus maintains a relatively constant outlet water temperature by controlling burner operation in response to the water temperature of both return water and outlet water. The temperature of the return water, as sensed by thermistor T1, effects on and "off" operation of the burner while the temperature of the outlet water, as sensed by thermistor T2, effects the rate of gas flow. The actual calibrated temperature values of the return water temperature set-point and the outlet water temperature set-point and the temperature difference therebetween are dependent upon various factors, such as the BTu rating of the main burner 38, the efficiency of the boiler 10, and the heat loss of the space heating system. However, once these temperature values have been established and when the system is operating within the design parameters of the system, the above-described system is capable of maintaining an outlet water temperature which only varies between a temperature slightly below the return water temperature set-point and a temperature slightly above the outlet water temperature set-point.

While the invention has been illustrated and described in detail in the drawings and foregoing description, it will be recognized that many changes and modifications will occur to this skilled in the art. It is therefore intended, by the appended claims, to cover any such changes and modifications as fall within the true spirit and scope of the invention.

We claim:

1. In a gas burner control system for a boiler in a circulating hot water system, a burner, a main valve for controlling the flow of gas to said burner and including on-off control means, a variably biased pressure regulator for controlling the rate of gas flow through said main valve including means operative to vary the bias of said regulator, outlet water conduit means for conducting heated water from the boiler to a radiating system, return water conduit means for conducting water to be heated back into the boiler from said radiating system, means responsive to the temperature of water in said return water conduit means for controlling the operation of said on-off control means, and means responsive to the temperature of water in said outlet water conduit means for controlling operation of said variable biasing means.

2. The control system claimed in claim 1 in which said means responsive to the temperature of water in said return water conduit means includes a thermistor and in which said means responsive to the temperature of water in said outlet water conduit means includes a thermistor.

3. In a gas burner control system for a boiler in a circulating hot water system, a burner, a main valve for controlling the flow of gas to said burner, electromagnetic means including a winding operative to effect the opening of said main valve when energized, a variably biased pressure regulator operative to vary the pressure of gas flowing to said burner in accordance with the bias thereon, solenoid means including a winding operative to vary the bias on said regulator in accordance with the rate of current flow through its winding, outlet water conduit means for conducting heated water from the boiler to a radiating system, return water conduit means for conducting water to be heated back into the boiler from said radiating system, a first temperature variable resistor responsive to the temperature of water in said return water conduit means, a second temperature variable resistor responsive to the temperature of water in said outlet water conduit means, an electrical power source, first circuit means connecting said first resistor across said power source, second circuit means connecting said second resistor across said power source, third circuit means for connecting said solenoid winding across said power source and including amplifying means connected to said second circuit means, and fourth circuit means connected to said first circuit means and rendered operative in response to a predetermined change in the resistance of said first resistor to effect connection of said electromagnetic winding across said power source and to effect connection of said third circuit means across said power source, said amplifying means being operative to vary the rate of current flow through said solenoid winding in accordance with variations in the resistance of said second resistor.

4. The control system claimed in claim 3 in which said first circuit means includes a bridge circuit having said first resistor in one arm thereof and manually variable resistance means in another arm thereof for establishing a water temperature in said return water conduit means at which said bridge circuit is balanced, said bridge circuit further including transistor amplifying means operative to render said fourth circuit means operative when said bridge circuit is unbalanced an amount due to said predetermined change in the resistance of said first resistor caused by a change in water temperature in said return water conduit means.

5. The control system claimed in claim 3 in which said fourth circuit means includes a series connected relay winding and transistor amplifying means, said relay winding being of such impedance as to require a predetermined output of said transistor amplifying means effected by said predetermined change in the resistance of said first resistor to effect closure of its contacts, said contacts being connected in series with said electromagnetic winding and said solenoid winding.

6. The control system claimed in claim 3 in which said third circuit means further includes a controlled solid state switch having gating means operative to fire said switch after a predetermined period of time following said connection of said third circuit means across said power source.

7. The control system claimed in claim 6 in which said gating means includes resistance capacitance means connected across said power sorce and a prgrammable unijunction transistor connected across said capacitor and to said third circuit means, said transistor being effective to prevent charging of said capacitor until said third circuit means is connected across said power source.

8. The control system claimed in claim 6 in which said second circuit means includes a bridge circuit having said second resistor in one arm thereof and manually variable resistance means in another arm thereof for establishing a water temperature in said outlet water conduit means at which said bridge circuit is balanced, said bridge circuit further including transistor amplifying means operative to initiate operation of said amplifying means in said third circuit means when said solid state switch is conducting and said bridge circuit is sufficiently unbalanced due to a predetermined change in the resistance of said second resistor caused by a change in water temperature in said outlet water conduit means.

9. In a burner control system for a boiler in a circulating hot water system, a burner, electrically operated on-off control means for controlling the flow of fuel to said burner, electrically operated modulating means for controlling the rate of fuel flow to said burner in accordance with the rate of current therethrough, outlet water conduit means for conducting heated water from the boiler to a radiating system, return water conduit means for conducting water to be heated back into the boiler from said radiating system, a first thermistor responsive to the temperature of water in said return water conduit means, a second thermistor responsive to the temperature of water in said outlet water conduit means, an electrical power source, bridge circuit means including said thermistors connecting across said power source, and circuit means connected to said bridge circuit means and rendered operative by said bridge circuit means in response to a predetermined change in the resistance of said first thermistor to effect energizing of said on-off control means and rendered operative by said bridge circuit means in response to a predetermined change in the resistance of said second thermistor to vary the rate of current flow through said modulating means in accordance with variations in the resistance of said second thermistor.

10. The control system claimed in claim 9 further including additional water conduit means connected to said outlet water conduit means for supplying domestic hot water and additional water conduit means connected to said return water conduit means for replenishing water expended for domestic use.

11. In a burner control system for a boiler in a circulating hot water system, a burner, electrically operated on-off control means for controlling the flow of gas to said burner, pressure regulator means for controlling the rate of gas flow to said burner and including minimum biasing means and variable biasing means, said minimum biasing means being effective for providing a minimum rate of gas flow whenever said on-off control means is energized, said variable biasing means including a solenoid winding and being operative to vary the rate of gas flow in accordance with the rate of current flow through its winding, outlet water conduit means for conducting water from the boiler to a heating load, return water conduit means for conducting water back into the boiler from said heating load, a first thermistor responsive to the temperature of water in said return water conduit means, a second thermistor responsive to the temperature of water in said outlet water conduit means, an electrical power source, first bridge circuit means connected across said power source and including said first thermistor for effecting the energizing of said on-off control means, second bridge circuit means connected across said power source and including said second thermistor for effecting the energizing of said variable biasing means, timing circuit means for limiting the rate of gas flow to said minimum rate for a predetermined time period, circuit means for connecting said timing circuit means across said power source only when said on-off control means is energized, and amplifying means connected to said second bridge circuit means operative after said predetermined time period to vary the rate of current flow through said winding in accordance with variations in the resistance of said second thermistor.

* * * * *